United States Patent [19]

Pouillon

[11] Patent Number: 4,742,721

[45] Date of Patent: May 10, 1988

[54] VIBRATING DEVICE

[75] Inventor: Emile R. J. Pouillon, Lasne, Belgium

[73] Assignee: 501 Cribla S.A., Netherlands

[21] Appl. No.: 360,580

[22] Filed: Mar. 22, 1982

[30] Foreign Application Priority Data

Mar. 26, 1981 [NL] Netherlands ..... 8101500

[51] Int. Cl.[4] ..... B06B 1/16

[52] U.S. Cl. ..... 74/61; 209/367; 366/128

[58] Field of Search ..... 74/61; 173/49; 404/117, 404/114, 113, 133; 198/770; 209/367; 366/128

[56] References Cited

U.S. PATENT DOCUMENTS

| | | | |
|---|---|---|---|
| 2,922,309 | 1/1960 | Adams | 74/61 |
| 2,970,660 | 2/1961 | Bodine | 74/61 |
| 2,975,846 | 3/1961 | Bodine | 74/61 |
| 4,242,918 | 1/1981 | Srogi | 74/61 |

FOREIGN PATENT DOCUMENTS

| | | | |
|---|---|---|---|
| 1072191 | 12/1959 | Fed. Rep. of Germany . | |
| 2357314 | 3/1978 | France . | |
| 7004107 | 8/1971 | Netherlands . | |
| 932782 | 3/1962 | United Kingdom | 74/61 |

*Primary Examiner*—Allan D. Herrmann

*Attorney, Agent, or Firm*—John P. Snyder

[57] ABSTRACT

A vibrating device, the vibrating part of which is equipped with a plurality of intercoupled unbalanced, shafts rotatably driven, in which the centrifugal forces generated neutralize one another in the direction at right angles to the direction of vibration and have the same directions in the direction of vibration, wherein the central shaft is provided on both sides whereof unbalanced shafts are located.

5 Claims, 1 Drawing Sheet

VIBRATING DEVICE

Figure 1:
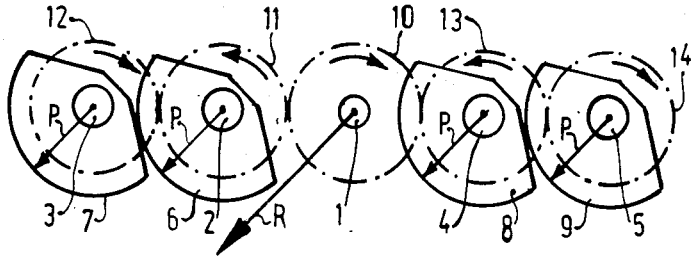

The invention realtes to a vibrating device, the vibrating part of which is equipped with a plurality of pairwise intercoupled, unbalanced shafts rotatably driven in synchronism in opposite senses, in which the centrifugal forces generated by the unbalances neutralise one another in a direction at right angles to the direction of vibration of the vibrating part and have the same directions in the direction of vibration and then amplify one another. Known vibrating devices of this kind, which may be sed for driving a sieve, may comprise two unbalanced shafts arranged in a water-tight housing, the shafts being located in a plane at right angles to the direction of vibration. By means of co-operating pinions, the shafts rotate in opposite senses. The unbalances co-operate in a manner such that in the direction of vibration the forces are summed up, whereas in the plane at right angles to the direction of vibration the forces compensate one another. There do not occur free moments. The disadvantage of such a construction is that lubrication of the pinions and the bearings may give rise to difficulties. When splash lubrication is used, problems may be involved because the bearings are not located at the same level so that the higher bearings receive poor lubrication.

If in such a device lubrication should be improved, the shafts can be disposed in the same horizontal plane. Then the vibrating direction is at an acute angle to said plane going through the axes. This has the advantage that the improved lubrication aimed at is obtained. Contrary thereto, however, is the disadvantage that the moments produced by the unbalances will not neutralise one another. This means that the vibrating device imparts an elliptic motion to the sieve surface connected herewith.

In practice it is a tendency to use ever larger vibrating surfaces. This involves heavier vibrating surfaces and a requirement for heavier centrifugal forces to be produced by the unbalanced shafts. The number of shafts may be doubled so that higher forces become available. Since four shafts are located side by side it is absolutely necessary to dispose them in a horizontal plane, since otherwise lubrication of the higher shafts would give rise to excessive difficulties. However, this aggravates the disadvantage that, like in the former case, large free moments are left. Thus also in this case the vibrating surface will perform elliptic motions.

The invention has for its object to provide a vibrating device in which high centrifugal forces are, indeed, produced, but in which the disadvantage of the production of an elliptic vibration is eliminated.

According to the invention the vibrating part is equipped with at least four unbalanced shafts, which are pairwise located on both sides of a balanced, central shaft, with which they are coupled, whilst the five shafts are all located in the same plane in a manner such that two unbalanced shafts neighbouring the central shaft are driven in one directions and the shafts located on the outer side with respect tot he central shaft are driven in the other direction.

By this disposition the moments exerted by the centrifugal forces neutralise one another. This results in a perfectly rectilinear vibrating movement despite the use of a plurality of unbalanced shafts and the necessity to drive heavy vibrating surfaces.

The invention will be described more fully hereinafter with reference to the drawing.

Figure 2:
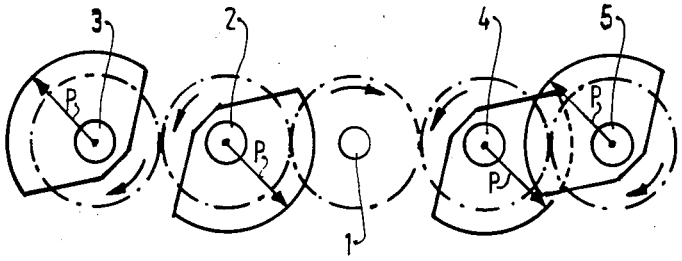
Figure 3:
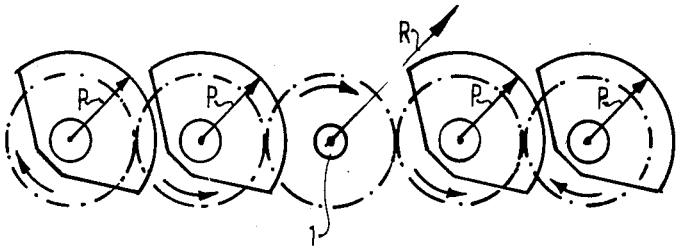

The drawing shows in:

FIG. 1 schematically a vibrating device embodying the invention,

FIG. 2 the device of FIG. 1 in a different position,

FIG. 3 the device in a further different position,

FIG. 4 the device again in a different position, and

FIGS. 5*a*, 5*b*, 5*c* and 5*d*, a second embodiment of the invention.

On both sides of a central shaft 1 are located unbalanced shafts 2,3,4 and 5. The shafts 2,3,4 and 5 are provided with unbalances 6,7,8 and 9 respectively. The shafts 1,2,3,4 and 5 are provided with pinions 10,11,12,13 and 14 respectively. These pinions are in mesh with one another so that the various shafts will rotate with the same speed when the central shaft 1 is driven. The central shaft 1 is balanced.

The centrifugal forces exerted by the unbalances are designated by P, whereas the resulting force acting on the device is designated by R.

As shown in FIG. 1, the centrifugal forces are all directed in the direction of vibration and all of them add up to the resultant.

In the position shown in FIG. 2 the forces are at right angles to the direction of vibration and the resultant in the direction of vibration is zero. Owing to the fact that the unbalanced shafts 2,4 and 3,5 are pairwise driven in the same directions, the forces P will not produce a moment for the shafts 2 and 4 located near the shaft 1. The same applies to the shafts 3 and 5.

Referring to FIG. 3, the resultant of the forces sis opposite those of FIG. 1 The force extends here again in the direction of vibration.

Figure 4:
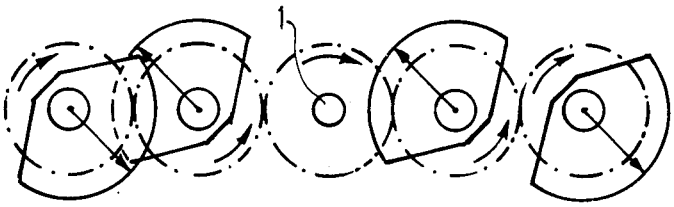

In the position shown in FIG. 4 the resulting force is again zero, whereas the moments exerted by the forces neutralise one another. This results in a perfectly rectilinear vibration. By using four unbalanced shafts very heavy forces can be produced and since the shafts are located in a horizontal plane, lubrication of the various shafts will not give rise to difficulties.

Figure 5A:
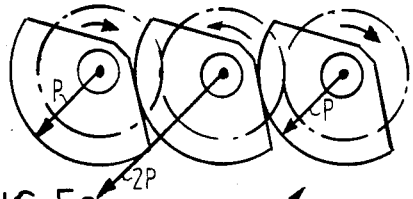
Figure 5B:
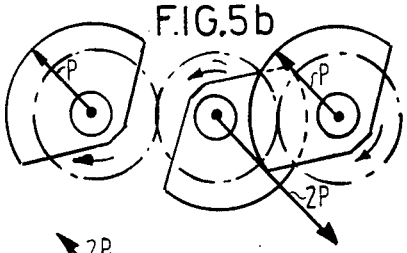
Figure 5C:
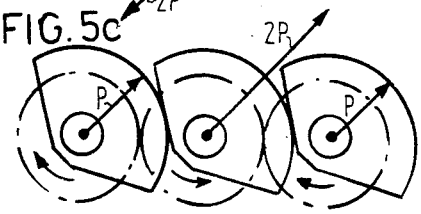
Figure 5D:
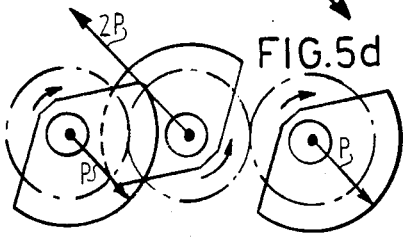

Referring to FIGS. 5*a*, 5*b*, 5*c* and 5*d* one of the two unbalanced shafts located pairwise on both sides of the central shaft is combined with the central shaft to form a single shaft. The central shaft is, therefore, out of balance to the mass like the adjacent shafts. FIGS. 5*a*, *b*, *c* and *d* show that the centrifugal forces are summed up in the direction of vibration and eliminate one another in the direction at right angles thereto. There are no resulting moments.

What I claim is:

1. A device for imparting vibrational drive to a surface such as a sieve, which comprises a series of parallel shafts disposed in the same plane and means for driving said shafts in unison so that any adjacent pair of shafts rotate in opposite directions, there being an odd number of shafts, an eccentric weight means on all but the central shaft of the series and each eccentric weight means being of the same weight value for summing the centrifugal effects of such weight means in two mutually opposite directions thereof which lie in a particular plane at an acute angle to said same plane, for effecting a summation of moments about the central shaft of said series which is always equal to zero, and for canceling the centrifugal effects of such weight means in two mutually opposite directions which are orthogonal to said particular plane.

2. A device as defined in claim 1 wherein there are five shafts in the series and the eccentric weight means are located on all but the central shaft of the series.

3. A device as defined in any one of claims 1 or 2 wherein said same plane is horizontal.

4. A device as defined in claim 3 wherein said acute angle is 45°.

5. A device as defined in claim 1 wherein said acute angle is 45°.

* * * * *